US007965256B2

(12) United States Patent
Haight

(10) Patent No.: US 7,965,256 B2
(45) Date of Patent: Jun. 21, 2011

(54) SEGMENTED ANTENNA REFLECTOR

(75) Inventor: Richard Haight, Courtice (CA)

(73) Assignee: ASC Signal Corporation, Smithfield, NC (US)

( * ) Notice: Subject to any disclaimer, the term of this patent is extended or adjusted under 35 U.S.C. 154(b) by 464 days.

(21) Appl. No.: 12/126,434

(22) Filed: May 23, 2008

(65) Prior Publication Data

US 2008/0291118 A1 Nov. 27, 2008

Related U.S. Application Data

(60) Provisional application No. 60/940,035, filed on May 24, 2007.

(51) Int. Cl.
*H01Q 15/20* (2006.01)

(52) U.S. Cl. ..... 343/915; 343/916; 343/912

(58) Field of Classification Search ..... 343/915
See application file for complete search history.

(56) References Cited

U.S. PATENT DOCUMENTS

| | | | | |
|---|---|---|---|---|
| 3,397,399 | A | 2/1966 | Carman et al. | |
| 3,715,760 | A | 2/1973 | Palmer | |
| 4,458,251 | A | 7/1984 | Bondon | |
| 4,506,271 | A | 3/1985 | Gonzalez | |
| 4,529,277 | A | 7/1985 | Gee et al. | |
| 4,893,132 | A | 1/1990 | Habibi | |
| 5,050,976 | A | 9/1991 | Flint | |
| 5,104,211 | A * | 4/1992 | Schumacher et al. | 359/853 |
| 5,255,006 | A | 10/1993 | Pappas et al. | |
| 5,257,034 | A * | 10/1993 | Turner et al. | 343/915 |
| 6,417,818 | B2 * | 7/2002 | Shipley et al. | 343/915 |
| 6,531,992 | B1 * | 3/2003 | Ehrenberg et al. | 343/912 |
| 6,624,796 | B1 | 9/2003 | Talley et al. | |
| 7,023,401 | B2 * | 4/2006 | Thrash et al. | 343/915 |
| 7,324,057 | B2 | 1/2008 | Argaman et al. | |
| 2006/0007050 | A1 * | 1/2006 | Thrash et al. | 343/916 |

OTHER PUBLICATIONS

GIGASAT Product Brochure: FA-370 Antenna; downloaded in the US from URL: http://www.gigasat.com/products/flyawayantennas_new.htm on May 20, 2008. Original publication date unknown.

* cited by examiner

*Primary Examiner* — Trinh V Dinh
(74) *Attorney, Agent, or Firm* — Babcock IP, PLLC

(57) ABSTRACT

An antenna reflector provided with a plurality of segments, each of the segments provided with a plurality of end faces positioned along surfaces of the segments. The end faces of adjacent segments arranged in lateral and radial pairs, the lateral and radial pairs coupled together. At least one of the end faces of the radial pairs and of the lateral pairs extending proud of the respective surfaces, whereby when the radial pairs and the lateral pairs are connected, the adjacent segments contact one another only via the radial and lateral pairs.

20 Claims, 10 Drawing Sheets

SEGMENTED ANTENNA REFLECTOR

CROSS REFERENCE TO RELATED APPLICATIONS

This application claims the benefit of U.S. Provisional Patent Application No. 60/940,035, titled "Segmented Antenna Reflector", filed May 24, 2007 by Richard Haight and hereby incorporated by reference in its entirety.

Also demonstrative of related aspects of a Mobile Antenna System that incorporates elements of the invention are two U.S. Utility patent applications titled 1) "Mobile Antenna Support" and 2) "Rotatable Antenna Mount", both applications by Richard Haight inventor of the present invention, both filed May 23, 2008 and both hereby incorporated by reference in their respective entirety.

BACKGROUND

Earth Station Antennas utilize a reflector to concentrate satellite signals upon a sub reflector and or feed assembly. A large reflector concentrates weak signals, enabling low power high bandwidth satellite communications.

Large reflectors may be formed from a plurality of segments that are interconnected to form the desired reflector surface. Although smaller reflector segments improve the portability and repairability of the resulting antenna, each additional segment interconnection introduces the opportunity for shape errors in the assembled reflector due to cumulative misalignment and or warping of the individual segments.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

The inventor has recognized that, for shape accuracy, mobility and speed of assembly, an antenna reflector may be formed from segments that with a plurality of point to point interconnections. The point to point, rather than surface to surface, segment interconnections enable cost efficient precision segment interconnection keying during reflector assembly.

In the exemplary embodiments herein, the segmented antenna reflector is demonstrated as a generally parabolic circular dish reflector surface, for use in a mobile satellite earth station antenna. Alternatively, one skilled in the art will recognize that the reflector segment(s) may be formed in a range of other shapes and configurations, for example generally rectangular or elliptical, to form a reflector surface with an alternative shape, such as a planar reflector or an inner or outer toroidal section.

A first exemplary embodiment of a segmented reflector 2 is described in greater detail with reference to FIGS. 1-5.

Figure 1:
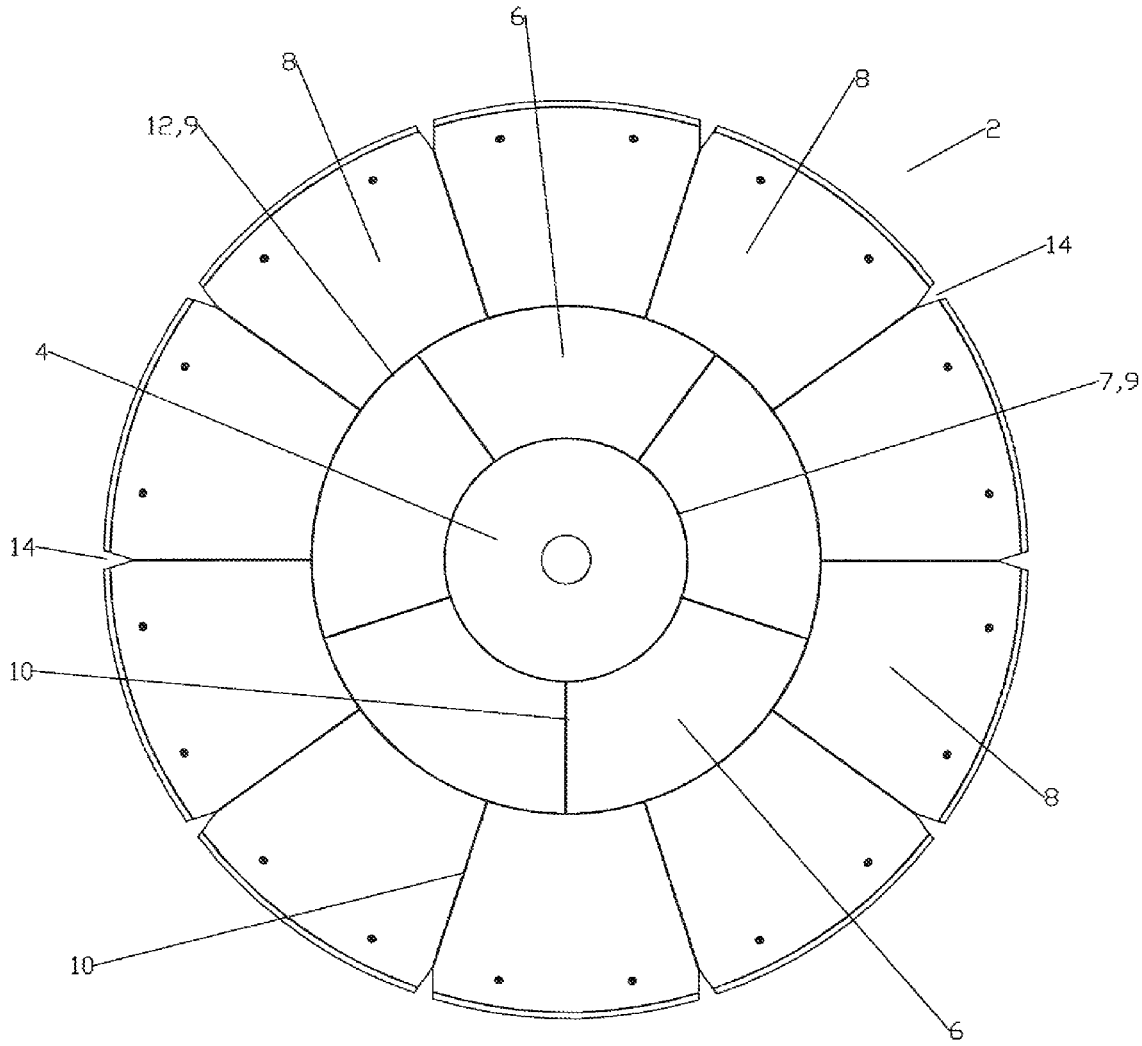
FIG. 1 is a schematic isometric front view of an exemplary reflector.
Figure 2:
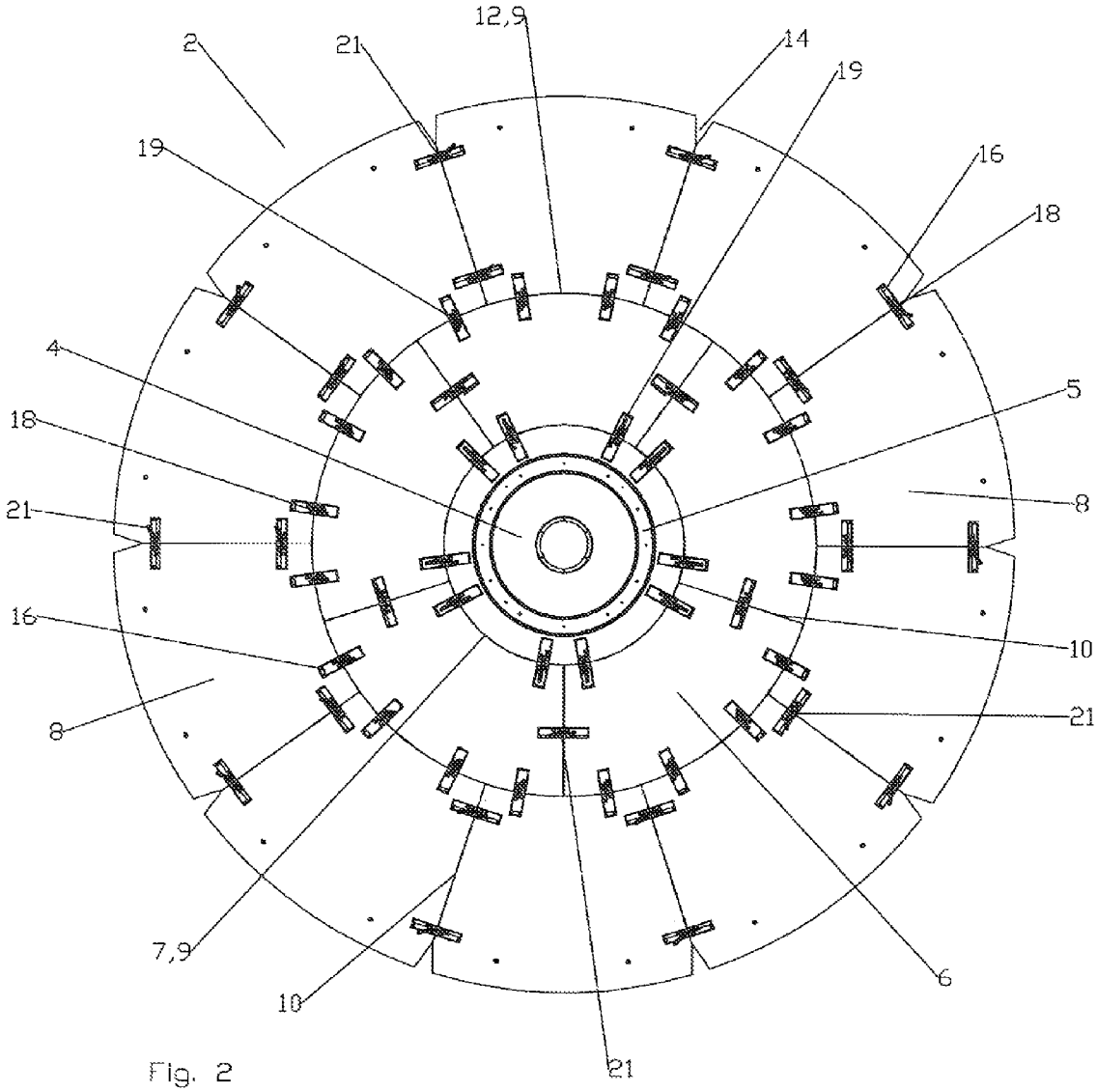
FIG. 2 is a schematic isometric back view of an exemplary reflector.
Figure 3:
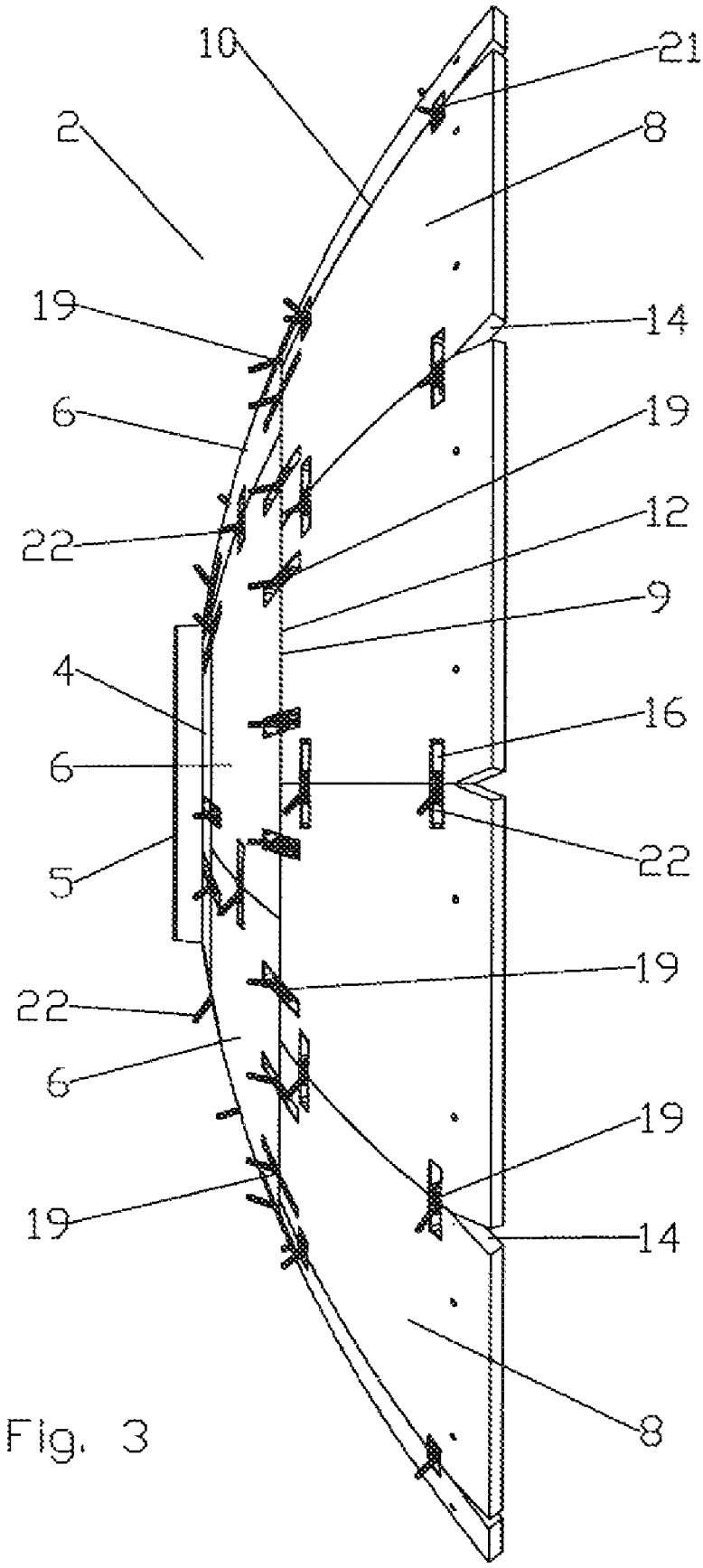
FIG. 3 is a schematic isometric side view of an exemplary reflector.
Figure 4:
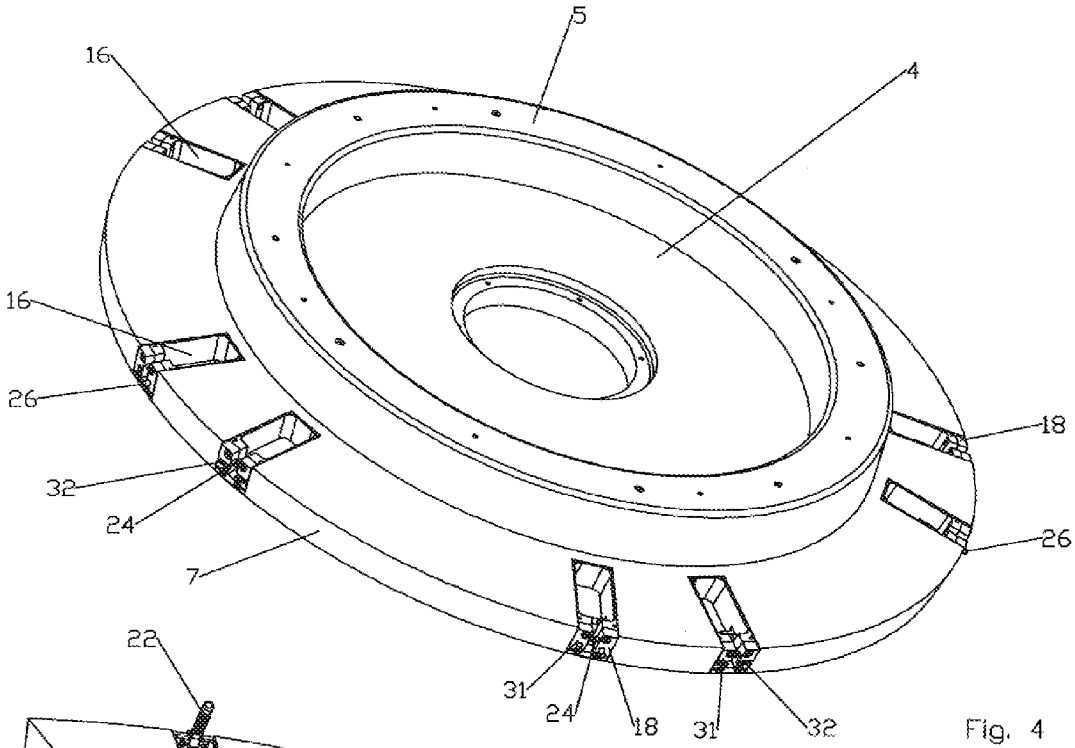
FIG. 4 is a schematic angled isometric back view of an exemplary central segment.
Figure 5:
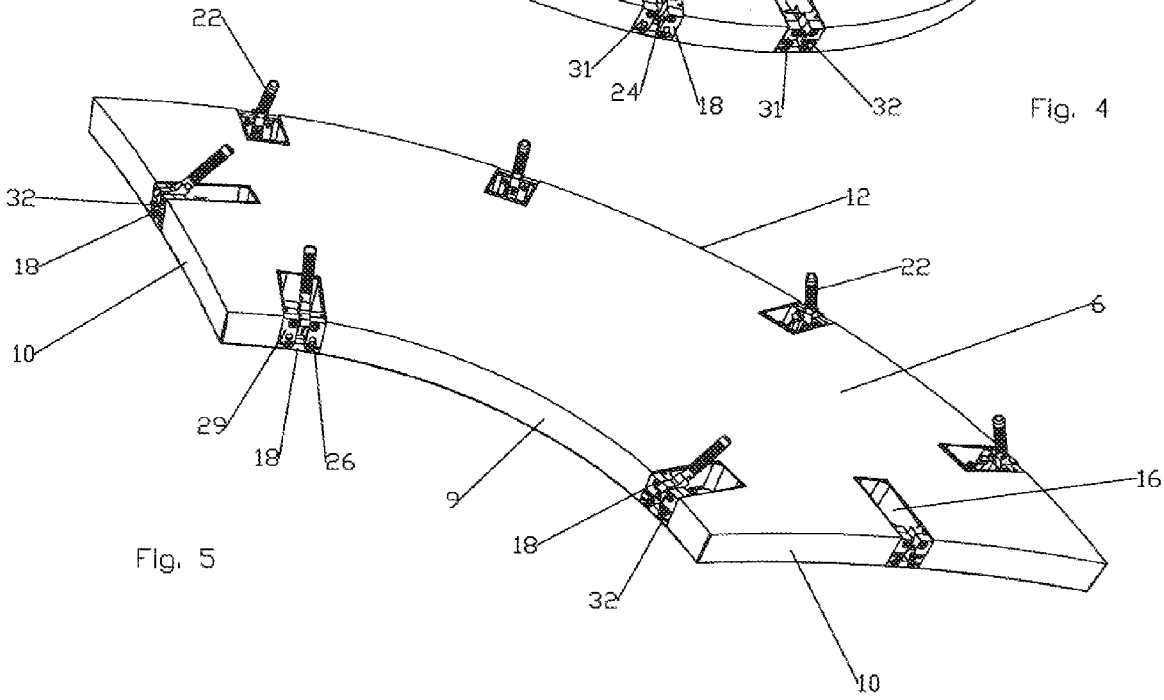
FIG. 5 is a schematic angled isometric back view of an exemplary peripheral segment.

The reflector 2 is comprised of a central segment 4, best shown in FIG. 4, to which a plurality of peripheral segment(s) are each attached. To improve manufacturing efficiency and spare parts inventory requirements, the reflector segments of the first exemplary embodiment are standardized into three shapes: the central segment 4, intermediate segment(s) 6, best shown in FIG. 5, and peripheral segment(s) 8. Surfaces of the different segments are hereafter provided with specific labels for ease of understanding segment orientation and explanation of details particular to specific surface to surface interconnections. In a general context, a surface is an edge or side of the segment along which a connection of one kind or another is made between segments and or between a segment and further elements.

The central segment 4 is generally circular, presenting a common peripheral surface 7 to which each of the plurality of intermediate segment(s) 6 mate with along an inner surface 9. A mounting surface 5 formed on the back of the central segment 4, reinforces the central segment 4 and provides a connection surface for an antenna mount, not shown. Side surface(s) 10 of each intermediate segment 6 may be linear, for example, extending along a radius line from a center of the central segment 4. The outer surface 12 of each intermediate segment 6 may be formed as an arc segment from the center of the central segment 4, thus providing a common surface profile for each of the peripheral segment(s) 8. The peripheral segment(s) 8 repeat the geometry of the intermediate segment (s) 6 based upon a larger arc radius and may also include features at the outer surface 12 that individually or in cooperation with adjacent peripheral segment(s) 8 form peripheral edge notch(s) 14 configured for antenna backlobe suppression. Further, the edge notch(s) 14 may be applied to reduce the shipping case size requirements, without significantly affecting electrical performance of the assembled antenna.

To improve the interlocking, alignment, shape accuracy and overall strength aspects of the reflector 2, where the peripheral segment(s) 8 mate with a portion of the intermediate segment(s) 6 outer surface 12 having a joint between adjacent intermediate segment(s) 6, the peripheral segment(s) 8 may be positioned to straddle both sides of the joint rather than align the joint with further joints between peripheral segment(s).

The various segments are interconnected via a plurality of means for locking such as cams, latches, captive bolts, over center latches, clamps, spring clips, threaded or snap fasteners or the like spaced around the periphery of each segment. The means for locking is demonstrated in the exemplary embodiment configured to share a common body 16 to which a range of differently configured end face(s) 18 may be attached. Arranged in pairs, the end face 18 first face 29 applied to each body 16 is selected to be complimentary to the opposing end face 18 second face 31 that it will connect with. The end face(s) 18 are aligned in radial pairs(s) 19 when connecting between the central segment 4 and one of the intermediate segment(s) 6 or between the intermediate segment(s) 6 and the peripheral segment(s) 8. The opposing end face(s) 18 are aligned in lateral pair(s) 21 when connecting between adjacent intermediate segment(s) 6 or peripheral segment(s) 8.

The body(s) 16 function as hardpoint(s) of the segments, allowing the remainder of each segment to be formed from lightweight and or cost efficient materials. The body(s) 16 may be fastened to the different segments using a means for fastening complimentary to the selected segment material. For example, the body(s) 16 may be bolted, riveted, welded, glued, integrally molded or machined in place upon the segments. Where additional reinforcement is desired, the area proximate the body 16 of each segment may be reinforced, for example with a metal insert, plate or the like. Each end face 18 may be configured for removable fastener attachment to the respective body 16 via common hand tools such as screw drivers and or allen keys for ease of field re-configuration and or repair. One or more body alignment pin(s) 20 may be applied to precision align each end face 18 to the corresponding body 16. To compensate for any manufacturing variances with respect to the various segments and or alignment of the attached body(s) 16, the end face(s) 18 interconnection with the respective body(s) 16 may be adapted for fine tuning via shims or spacers located between the body(s) 16 and the end face(s) 18. Alternatively, the end face(s) 18 may be permanently attached to each respective body 16, for example, once the shape accuracy of the assembled reflector has been verified.

Figure 7:
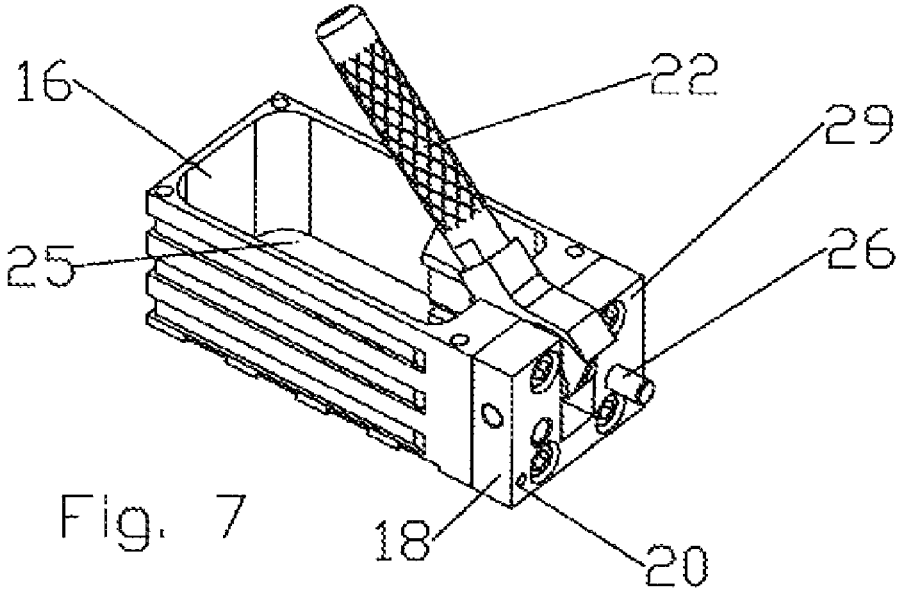
FIG. 7 is a schematic angled isometric side view of an exemplary body with locating pin end face.
Figure 8:
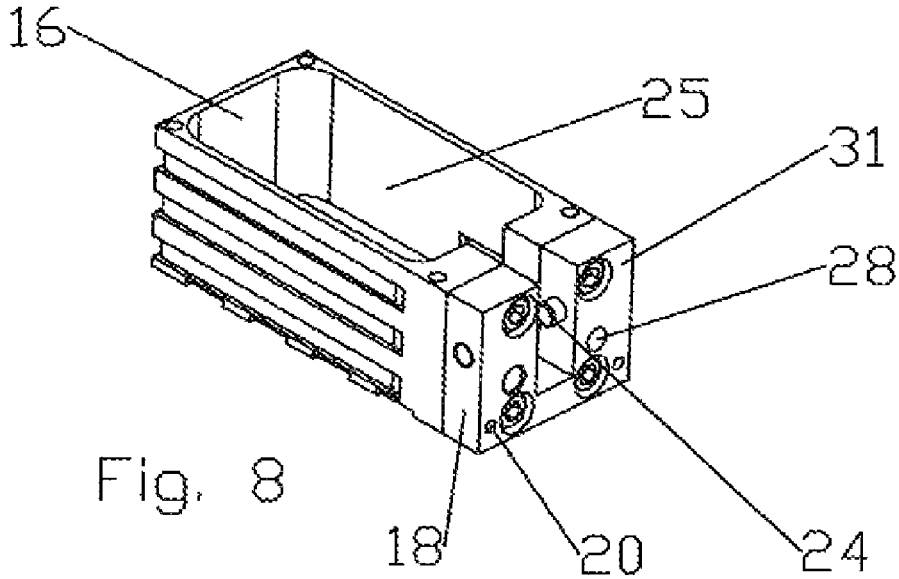
FIG. 8 is a schematic angled isometric side view of an exemplary body with socket end face.

On each segment, one of the radial pairs 19 along the arc surface may include a locating pin 26 into socket 28 as shown for example in FIGS. 7 and 8. The close tolerance locating pin 26 into corresponding socket 28 fit forming an interlocking feature with two axis of alignment. Similar to the application of shims between the body(s) 16 and endface(s) 18, the locating pin 26 position on each end face 18 may be adjusted as necessary. Thereby, without placing unrealistic manufacturing tolerance requirements on the molded segments, each segment may be configured for extremely high tolerance dimensional conformity segment to segment at the contact surfaces, such that for segments of each general type are interchangeable. The segment standardization features of the invention allow damaged segments to be easily exchanged in the field with replacement segments, in contrast to prior solutions that relied upon a mated set of segments each specifically dimensionally configured for specific interconnection with only the original set of segments.

Figure 6:
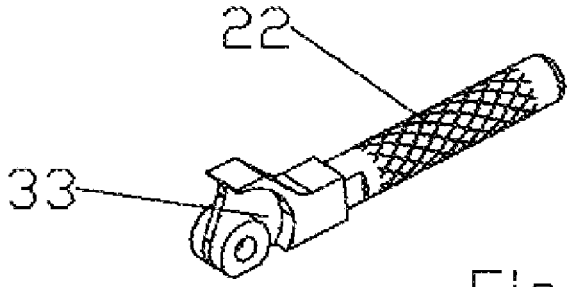
FIG. 6 is a schematic angled isometric side view of an exemplary cam arm.

The means for locking couples the radial and lateral pairs to one another, end face 18 to end face 18. In the first exemplary embodiment, as shown in FIG. 6, the means for locking is demonstrated as a cam arm 22 rotatably coupled to an end face 18, the first face 29. The cam arm 22 is provided with a groove 33 operable to engage a retention surface such as a pair of cam pin(s) 24 of a corresponding end face 18, the second face 31, as the cam arm 22 is swung from an open position in an aperture 25 of the body 16 to a closed position within the aperture 25 of the corresponding opposing body 16. The groove 33 may be formed as an arc a progressive engagement geometry, such as a decreasing radius, that draws the end face(s) 18 towards one another across the length of the arc swing between the open and closed positions. The progressive engagement geometry is especially useful during assembly, as a loose initial connection which simplifies attachment of additional segments may then be tightened, drawing the loosely fitted segments into a tight final interconnection. Because the progressive engagement geometry may be configured with an initial full closure position that is short of the final swing range of the cam arm 22, as the engaging surfaces wear over time the engagement force may be maintained at a consistent level merely by selecting a final cam arm 22 swing position that achieves the desired interconnection force. Also, because the cam mechanism engages with a swing motion assembly time is reduced, compared to interconnections utilizing threaded components that may be easier to foul, especially difficult and time consuming to connect, for example in severe environments.

Where the segments are formed with arc shaped inner and outer mating surfaces to enable segment standardization, it is preferred that only one of the radial pairs is configured with the locating pin 26 into socket 28 end face 18. Where multiple locating pin 26 into socket 28 end face 18 pairs are applied, at least one of the locating pin 26 into socket 28 end face 18 radial pairs would require an angle modification, increasing the number of unique components and or complicating the positioning of the body(s) 16 with respect to the segment edge surfaces.

Figure 9:
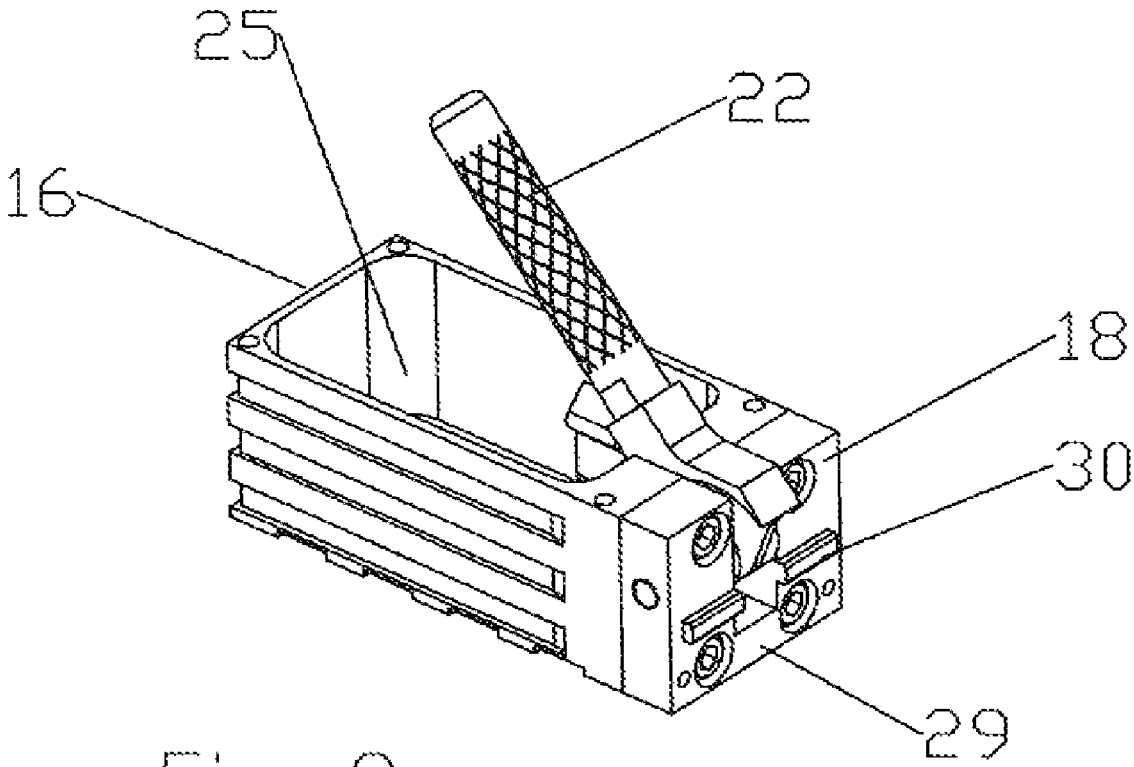
FIG. 9 is a schematic angled isometric side view of an exemplary body with tab end face.
Figure 10:
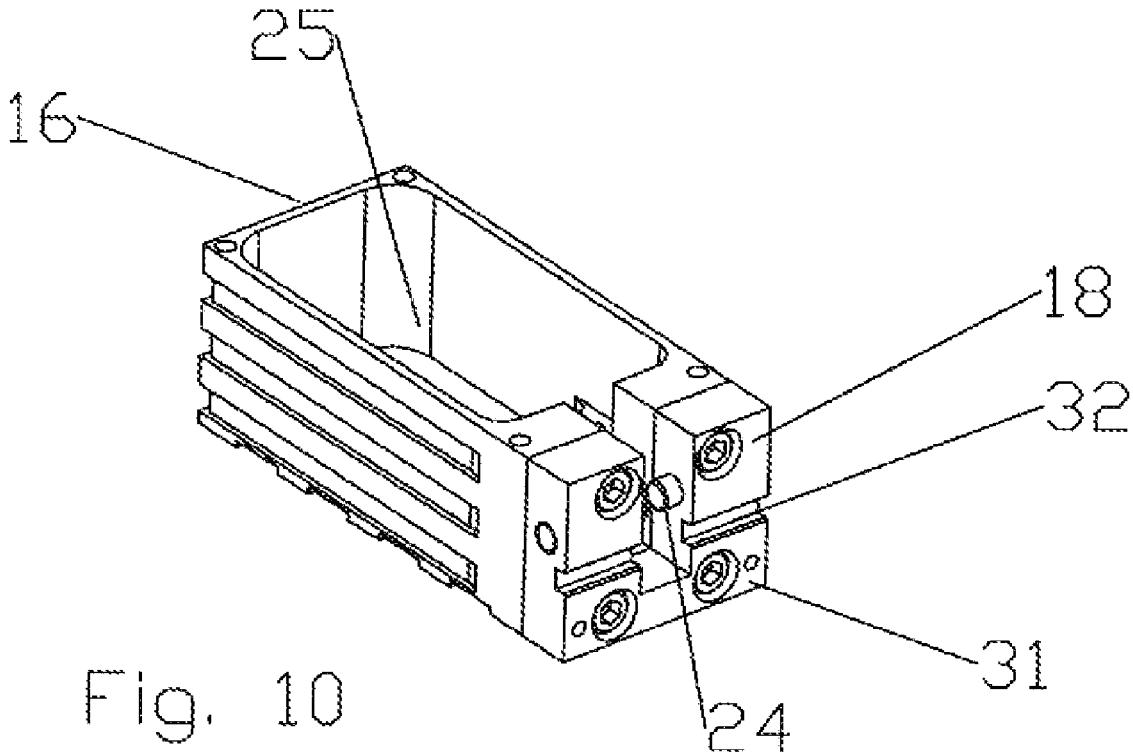
FIG. 10 is a schematic angled isometric side view of an exemplary body with slot end face.

To accommodate the insertion of at least one (for example the final one) of the ring of intermediate and peripheral segment(s) 6, 8 into a U-shaped opening formed by the adjacent segments during reflector 2 assembly, the remainder of the end face 18 radial and or lateral pairs may be formed with tab 30 of a first face 29 into slot 32 of a second face 31 that together form an interlocking feature with a single axis of alignment, as shown for example in FIGS. 9 and 10. The single axis is preferably arranged to be the general surface plane of the segments. Thereby, the segments may be inserted into the U-shaped opening along the general surface plane of the segments to engage each corresponding tab 30 into slot 32 as well as the single locating pin 26 into socket 28 to precision align each segment with the neighboring segments, prior to locking each end face 18 pair together via the selected means for locking.

Figure 11:
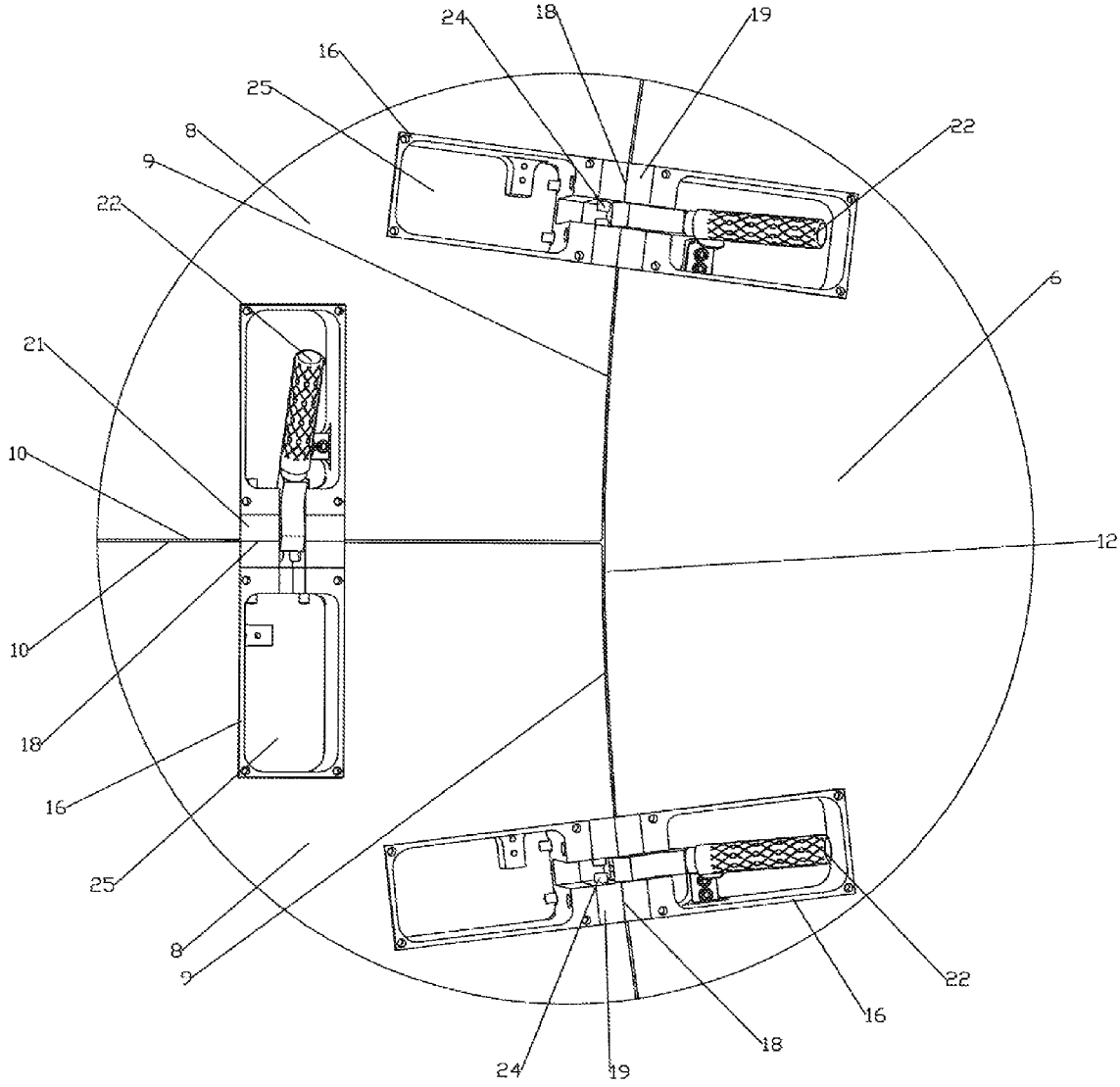
FIG. 11 is a schematic isometric top close-up view of radial pair and lateral pairs, demonstrating the spacing between the adjacent surfaces due to the endface position, proud of the surfaces.

As best shown in FIG. 11, to improve the precision of the segment to segment connection, and thus the resulting precision of the assembled reflector shape overall, at least one of each body 16, in combination with the dimensions of the selected end face(s) 18, is positioned to orient the attached end face 18 proud of the corresponding mating surface(s), for example the central segment 4 peripheral surface 7 to intermediate segment 6 inner surface 9. Thereby, once connected, the segments have contact between each pair of corresponding end face 18 surface(s) to end face 18 surface(s), only.

The precision aligned end face 18 to end face 18 connection maintains the desired reflector surface geometry but greatly reduces the precision required during segment fabrication, because only the end face 18 surface(s) rather than the entire segment edge surface need to be prepared for mating with a high degree of parallelism along their extents. Thereby, manufacturing costs are significantly reduced and the possibility for deformation of the reflector surface via rigid interconnection of slightly out of parallel, less than fully planar and or damaged segment edge surfaces is avoided.

Figure 12:
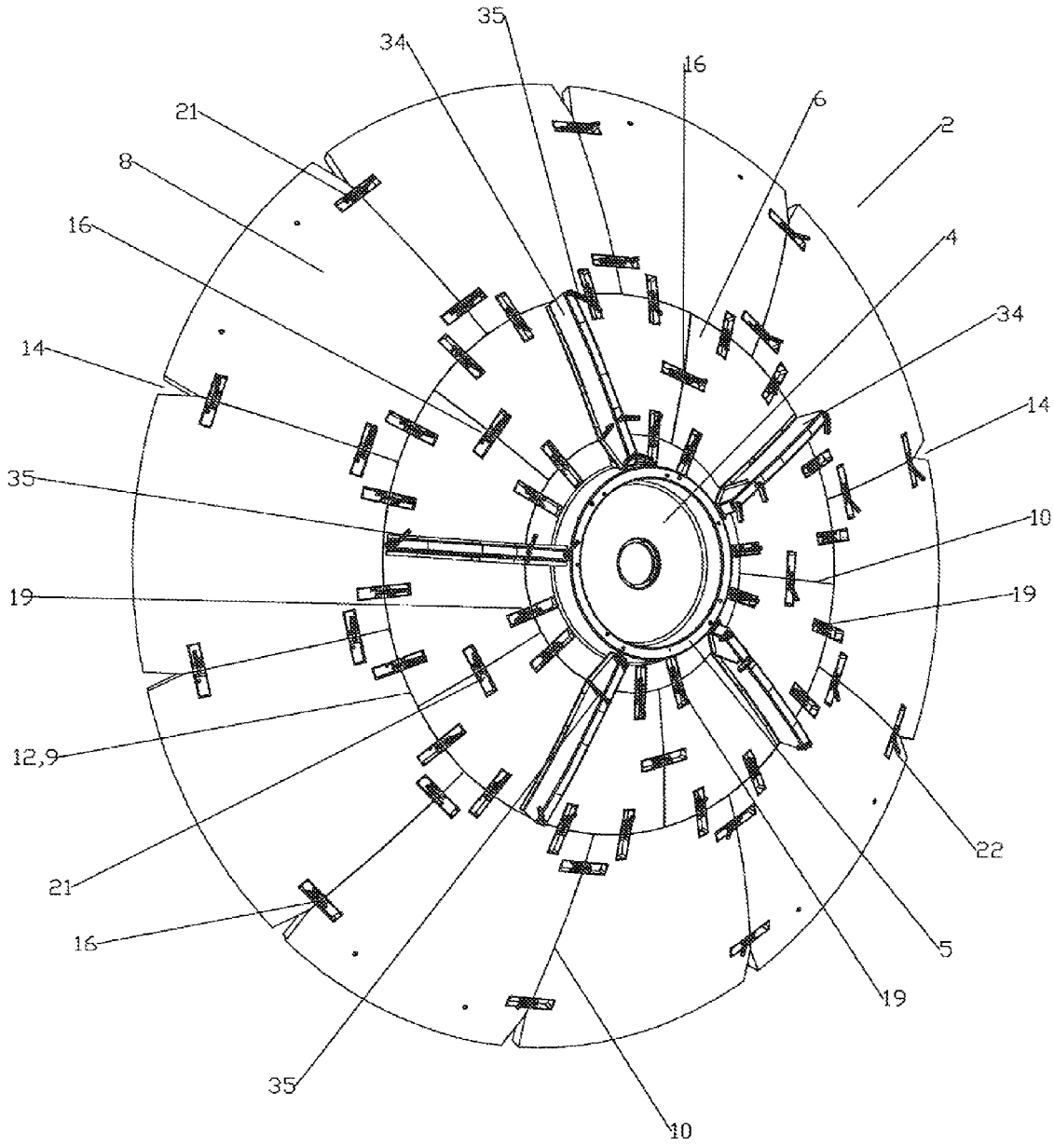
FIG. 12 is a schematic isometric back view of an exemplary reflector configured with reinforcing ribs.
Figure 13:
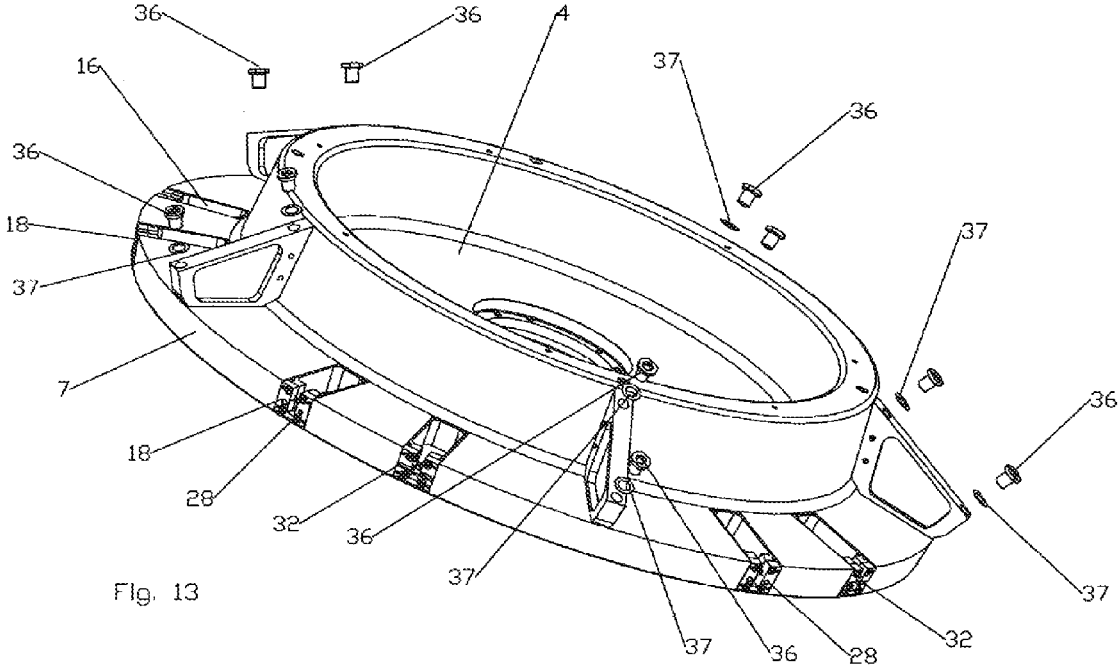
FIG. 13 is a schematic angled isometric back view of an exemplary central segment configured for attachment of reinforcing ribs.
Figure 14:
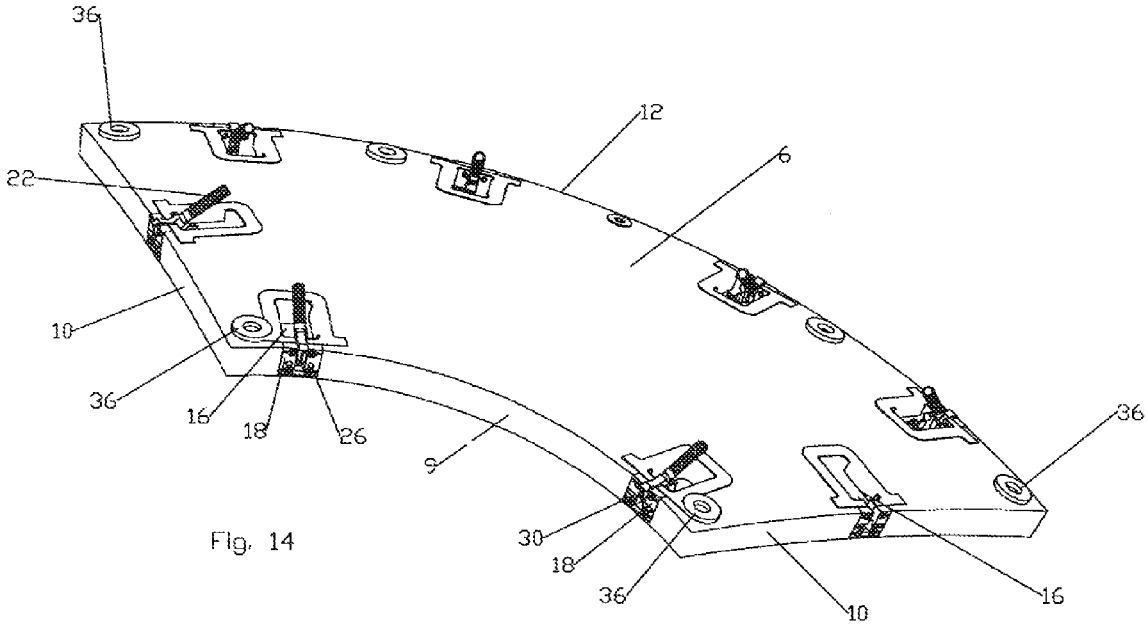
FIG. 14 is a schematic angled isometric back view of an exemplary peripheral segment configured for attachment of reinforcing ribs.
Figure 15:
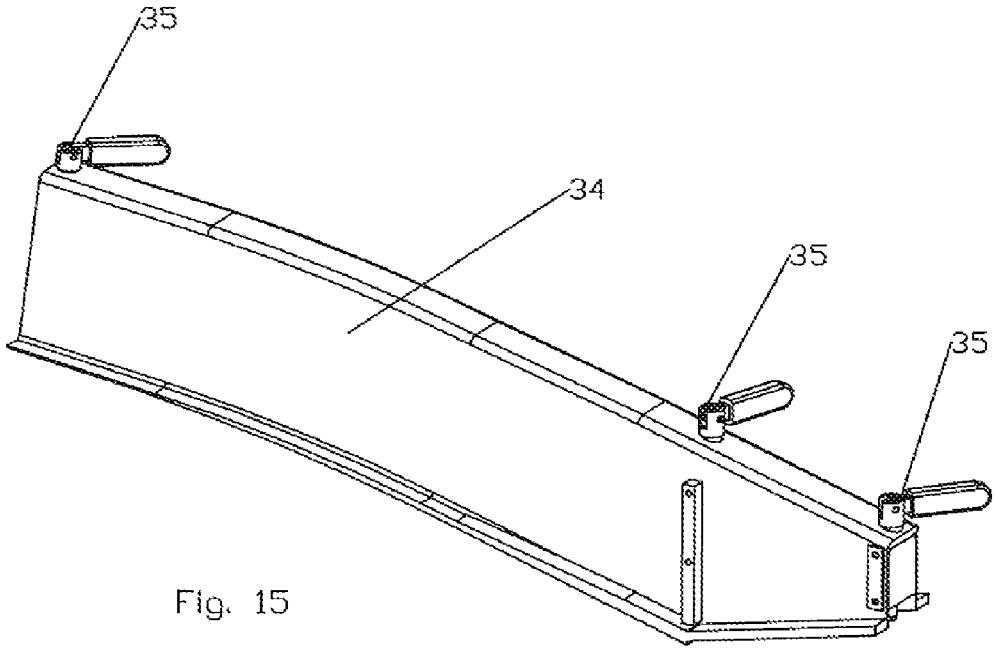
FIG. 15 is a schematic angled side view of an exemplary embodiment of a rib.
Figure 16:
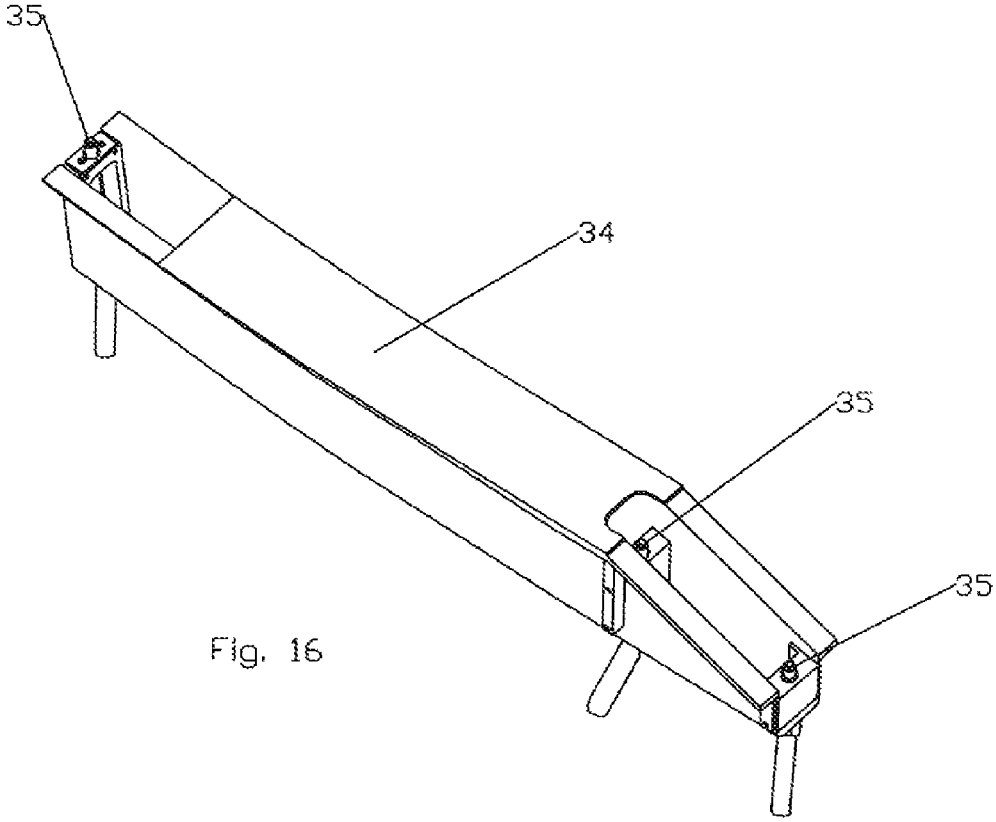
FIG. 16 is a schematic angled bottom view of an exemplary embodiment of a rib.

As shown in FIG. 12, additional reinforcement may be applied to the back side of the reflector dish, in the form of one or more rib(s) 34 preferably extending radially from the central segment 4 to the intermediate segment 6. Alternatively, the rib(s) 34 may extend to the peripheral segment(s) 8 also, if present. As shown in FIGS. 13-16, the rib(s) 34 may be coupled to the central segment 4 and other segment(s), for example, via fasteners 35 that mate with socket(s) 36 of the segment(s). Oriented normal to the general surface plane of the various segments, the rib(s) 34 significantly improve the strength and rigidity characteristics of the resulting reflector 2. As described herein above with respect to fine tuning of the segment dimensional tuning of the interconnection surfaces via shims inserted between the body(s) 16 and end face(s) 18, the socket(s) 36 may also be configured for tuning via shims such as washer(s) 37 that may be placed between the sockets and the respective segment surface.

Although the invention has been described with the assistance of an exemplary embodiment including a central segment 4 with a single ring each of intermediate and peripheral segments 6, 8 one skilled in the art will appreciate that the benefits of the invention may be realized in smaller or larger embodiments, depending upon the desired maximum reflector segment size and the desired antenna reflector surface area. For example, where smaller reflector surface area and or larger segment dimensions are desired, the ring of peripheral segments 8 may be omitted. Similarly, where a large reflector surface and or small reflector segment dimensions are desired, multiple successive rings of intermediate and or peripheral segments 6, 8 may be applied.

The present invention enables large surface area reflector surfaces comprised of easy to transport, assemble and or repair standardized segments and means for locking. The precision enabled by interconnection between the end face(s) 18, only, instead of along the full extent of the various segment edge surfaces, greatly increases the shape accuracy of the assembled reflector. Because individual segment edge surface dimensional precision requirements are reduced, advanced lightweight materials such as carbon fiber may be applied to the segment(s) without prohibitively increasing the overall costs of the resulting antenna reflector.

Table of Parts

| | |
|---|---|
| 2 | reflector |
| 4 | central segment |
| 5 | mounting surface |
| 6 | intermediate segment |
| 7 | peripheral surface |
| 8 | peripheral segment |
| 9 | inner surface |
| 10 | side surface |
| 12 | outer surface |
| 14 | notch |
| 16 | body |
| 18 | end face |
| 19 | radial pair |
| 20 | alignment pin |
| 21 | lateral pair |
| 22 | cam arm |
| 24 | cam pin |
| 25 | aperture |

-continued

Table of Parts

| | |
|---|---|
| 26 | locating pin |
| 28 | socket |
| 29 | first face |
| 30 | tab |
| 31 | second face |
| 32 | slot |
| 33 | groove |
| 34 | rib |
| 35 | fastener |
| 36 | socket |
| 37 | washer |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An antenna reflector, comprising:

a central segment with a peripheral surface and a plurality of intermediate segments; each of the intermediate segments having an outer surface, an inner surface and two side surfaces;

a plurality of bodies; an end face separately coupled to each of the bodies;

the peripheral surface provided with more than one of the bodies;

the inner surfaces and the side surfaces each provided with at least one of the bodies;

the end faces of the peripheral surface and the end faces of the inner surfaces aligned to form a plurality of radial pairs configured for releasable connection to each other;

the end faces of the side surfaces adjacent to each other aligned to form a plurality of lateral pairs configured for releasable connection to each other;

at least one of the end faces of the radial pairs and of the lateral pairs extending proud of the respective peripheral surface, inner surfaces or side surfaces, whereby when the radial pairs and the lateral pairs are connected, the peripheral surface does not touch the inner surfaces and the adjacent side surfaces do not touch each other.

2. The reflector of claim 1, wherein the end faces of at least one of the radial pairs and of the lateral pairs is provided with a cam arm on a first face and a cam pin on a second face; the cam arm pivotable to engage the cam pin, coupling the end faces together.

3. The reflector of claim 2, wherein the cam arm has a groove which progressively engages the cam pin as the cam arm is pivoted from an open to a closed position.

4. The reflector of claim 1, wherein the end faces of at least one of the radial pairs is provided with a locating pin on a first face and a socket on a second face; the locating pin seating into the socket as the end faces are mated together.

5. The reflector of claim 1, wherein the end faces of at least one of the lateral pairs is provided with a tab on a first face and a slot on a second face; the tab seating into the slot as the end faces are mated together.

6. The reflector of claim 1, wherein the coupling of the end faces to the central and intermediate segments is via a plurality of bodies coupled to the segments, the end faces removably connected to the bodies.

7. The reflector of claim 1, wherein the radial pairs and the lateral pairs are coupled by a means for locking.

8. The reflector of claim 1, wherein the end faces of at least one of the radial pairs are provided with an interlocking feature having two axis of alignment.

9. The reflector of claim 1, wherein the end faces of at least one of the lateral pairs are provided with an interlocking feature having one axis of alignment.

10. The reflector of claim 1, further including a plurality of peripheral segments; each of the peripheral segments having an inner surface, two side surfaces and an outer surface;

the peripheral segment inner surfaces and the peripheral segment side surfaces each provided with at least one of the bodies;

the outer surfaces of the intermediate segments provided with a least one of the bodies;

the end faces of the outer surfaces of the intermediate segments and the end faces of the peripheral segment inner surfaces aligned in peripheral radial pairs configured for releasable connection;

the end faces of the adjacent peripheral segment side surfaces adjacent to each other aligned in peripheral lateral pairs configured for releasable connection;

at least one of the end faces of the peripheral radial pairs and of the peripheral lateral pairs extending proud of the respective peripheral surface, inner surfaces or side surfaces, whereby when the peripheral radial pairs and the peripheral lateral pairs are connected, the intermediate segment peripheral surfaces do not touch the peripheral segment inner surfaces and the adjacent peripheral segment side surfaces do not touch each other.

11. The reflector of claim 10, further including at least one rib; the rib coupled to the central segment and a peripheral segment by a plurality of fasteners.

12. The reflector of claim 10, further including at least one notch in the outer surface.

13. An antenna reflector, comprising:

a plurality of segments, each of the segments provided with a plurality of end faces positioned along surfaces of the segments;

the end faces adjacent to each other arranged in a plurality of lateral and radial pairs, the lateral and radial pairs coupled together;

at least one of the end faces of the radial pairs and of the lateral pairs extending proud of the respective surfaces, whereby when the radial pairs and the lateral pairs are connected, the adjacent segments contact one another only via the radial and lateral pairs.

14. The reflector of claim 13, wherein the connected segments form a parabolic reflector surface.

15. The reflector of claim 13, wherein each of the end faces are removably coupled to a body, the bodies coupled to the segments.

16. The reflector of claim 13, wherein the end faces of at least one of the radial pairs are provided with an interlocking feature having two axis of alignment.

17. The reflector of claim 13, wherein the end faces of at least one of the lateral pairs are provided with an interlocking feature having one axis of alignment.

18. The reflector of claim 13, wherein the end faces of at least one of the radial pair(s) and of the lateral pair(s) is provided with a cam arm on a first face and a cam pin on a second face; the cam arm pivotable to engage the cam pin, coupling the end faces together.

19. The reflector of claim 18, wherein the cam arm has a groove which progressively engages the cam pin as the cam arm is pivoted from an open to a closed position.

20. The reflector of claim 13, further including at least one rib; the rib coupled between a central segment and at least one adjacent segment by a plurality of fasteners, the at least one rib oriented normal to the central and at least one adjacent segment.

* * * * *